US008240931B1

(12) United States Patent
Collins

(10) Patent No.: US 8,240,931 B1
(45) Date of Patent: Aug. 14, 2012

(54) PEN AND HIGHLIGHTER WITH RETRACTABLE BOOKMARK

(76) Inventor: Ruth R. Collins, Dallas, TX (US)

( * ) Notice: Subject to any disclaimer, the term of this patent is extended or adjusted under 35 U.S.C. 154(b) by 580 days.

(21) Appl. No.: 12/387,052

(22) Filed: Apr. 27, 2009

Related U.S. Application Data

(60) Provisional application No. 61/125,316, filed on Apr. 25, 2008.

(51) Int. Cl.
*B43K 29/00* (2006.01)
*B43K 23/02* (2006.01)

(52) U.S. Cl. ..... 401/131; 401/17; 401/23; 401/52; 401/195

(58) Field of Classification Search ..... 401/17, 401/20, 23, 52, 131, 195; 116/234, 237; 281/48; 24/128
See application file for complete search history.

(56) References Cited

U.S. PATENT DOCUMENTS

| | | | | | |
|---|---|---|---|---|---|
| 155,196 | A | | 9/1874 | McNair | |
| 1,974,667 | A | * | 9/1934 | Solinger | 401/52 |
| 2,175,962 | A | * | 10/1939 | Kenifick | 24/128 |
| 2,300,216 | A | | 10/1942 | Grodsky et al. | |
| 3,733,139 | A | | 5/1973 | Neidhardt et al. | |
| D279,992 | S | | 8/1985 | Gribb | |
| 4,934,304 | A | * | 6/1990 | Rosen | 116/237 |
| 4,982,685 | A | * | 1/1991 | Abe | 116/237 |
| D322,811 | S | | 12/1991 | Isern | |
| D355,933 | S | | 2/1995 | Collins | |
| 5,829,903 | A | | 11/1998 | Collins | |
| 6,006,693 | A | | 12/1999 | Burkett | |
| D429,499 | S | | 8/2000 | Mershon | |
| D452,270 | S | | 12/2001 | Mershon | |
| 7,475,654 | B2 | * | 1/2009 | Scott | 116/237 |
| 2002/0139291 | A1 | | 10/2002 | Roundy | |

* cited by examiner

*Primary Examiner* — David Walczak
*Assistant Examiner* — Bradley Oliver
(74) *Attorney, Agent, or Firm* — Montgomery Patent & Design LLC; Robert C. Montgomery; Joseph Yaksich

(57) ABSTRACT

A pen/highlighter having an integral retractable tethered bookmark comprising a double-ended writing instrument having a ball point pen at a first end and a highlighter at a second end is disposable and replaceable, thereby allowing a user to refill the device with common refills comprising different color inks. A pen cap portion comprises a tethered interchangeable bookmark depicting such items as a charm, a school or corporate logo, a sports team logo, an entertainment or musical icon, among others. A thin retractable cord connects the bookmark to the device providing a retracting mechanism within the pen cap. An internal locking device secures the bookmark at a maximum extended length as well as variable partial lengths. In such a manner, the cord can be used to mark a page in a book while the bookmark hangs out of a bottom portion of said book.

16 Claims, 4 Drawing Sheets

PEN AND HIGHLIGHTER WITH RETRACTABLE BOOKMARK

RELATED APPLICATIONS

The present invention was first described in and claims the benefit of U.S. Provisional Application No. 61/125,316, filed Apr. 25, 2008, the entire disclosures of which are incorporated herein by reference.

FIELD OF THE INVENTION

The present invention relates generally to writing devices and, more particularly, to a writing device one end adapted for use as a pen and an opposite end adapted for use as a highlighter having a combined bookmarking device.

BACKGROUND OF THE INVENTION

There are many instances while reading a book that a writing instrument is desired, such as when a margin note needs to be made or several words or lines need to be highlighted. This is especially useful for students, teachers, and professionals of all ages. Many times a person my elect to not make these marks or notes since they lack an available proper writing implement, which can lead to retention levels or grades suffering. The lack of having the proper writing implement is commonly due to the need to carry numerous types of writing devices along with the book itself. If the various writing instruments are carried loose or in a pocket, they may become lost, misplaced, or stolen.

Similar problems exist when marking a page in a book. Scraps of papers are often used as make-shift bookmarks, page corners are folded, as well as many other methods are attempted, but none of these solutions beats the functionality or efficiency of a real bookmark.

Various attempts have been made in the past to overcome these disadvantages and provide a means of providing bookmarks, pencil holders, combined writing implements, and the like. None of the prior attempts to solve the problems often encountered by a hurried student or professional have addressed the combination of disadvantages. Among the relevant attempts to address these problems are several U.S. patents.

U.S. Pat. No. 155,196, issued in the name of McNair, describes a compound implement consisting of a bookmark, a blade, a clamp, and a pencil holder having a sufficient spring to hold the blade and the clamp together on the pages of a book.

U.S. Pat. No. 2,300,216, issued in the name of Grodsky et al., describes a bookmark comprising a combined bookmark and pencil holder consisting of a strip of flexible material that is bent having an upper loop to receive the pencil and two (2) flat contiguous leg members that engage the pages of a book.

U.S. Pat. No. 3,733,139, issued in the name of Neidhardt et al., describes a dual writing instrument comprising a central body with open end portions adapted to removably receive end bodies comprising a disposable ink cartridge for use as a ball point pen and a writing fluid chamber for use as a felt tip pen.

U.S. Pat. No. 6,006,693, issued in the name of Burkett, describes a bookmark with highlighter pen comprising a narrow elongated bookmark portion with an enlarged highlighter pen on an upper end and a highlighter cap. The bookmark can be oriented between pages or used as a highlighter while reading.

U.S. Published Application number 2002/0139291, published in the name of Roundy, describes an ultimate bookmark comprising a rectangular body with detailed page finding markers which provides up to eight (8) page markers.

U.S. Pat. No. 5,829,903, issued in the name of Collins, describes a writing implement and cap therefore having an integral bookmark comprising a ball point pen end, a highlighter pen end, a pen cap, and a highlighter cap having an integral blade portion with functions as a bookmark device that is slidably received between book pages at the spine end of the book.

Additionally, ornamental designs for writing instruments and bookmarks exist, particularly, U.S. Pat. No. D 279,992; D 322,811; D 355,933; D 429,499 and D 452,270. However, none of these designs are similar to the present invention.

While these devices fulfill their respective, particular objectives, each of these references suffers from one (1) or more of the aforementioned disadvantages. Accordingly, there is a need for a means by which the functionality of a pen, a highlighter, and a bookmark can be provided in a common device. The development of the present invention herein described substantially departs from the conventional solutions and in doing so fulfills this need.

SUMMARY OF THE INVENTION

In view of the foregoing references, the inventor recognized the aforementioned inherent problems and observed that there is a need for a means to provide for various kinds of writing implements and a bookmarking in a single convenient device which when used as a bookmark does not interfere with the profile of a book when opened or closed and thus, the object of the present invention is to solve the aforementioned disadvantages.

To achieve the above objectives, it is an object of the present invention to provide a pen and highlighter assembly with a retractable bookmark that combines the functions of a writing pen, a highlighter, and a bookmark into a single combined device.

Another object of the device is to provide a body, a pen portion, a highlighter portion, a pen cap, a molded pocket clasp, a connection cord, a recoil mechanism, and a plurality of bookmark assemblies.

Yet still another object of the device is to provide a a double-ended writing instrument having a first end comprising a ball point pen and a second end comprising a color highlighter. Both the pen and highlighter comprise disposable and replaceable marking tips and ink cartridges, thereby enabling a user to refill the device as desired and with different color inks.

Yet still another object of the device is to provide a pen cap portion comprising a pocket clasp and a plurality of interchangeable bookmark assemblies that are tethered to the cap portion and that depict various indicia such as a charm, a school or corporate logo, a sports team logo, an entertainment or musical icon, and the like. A thin retractable cord connects the bookmark assembly to the cap portion providing a recoiling mechanism within the pen cap. The cord and the attached bookmark assembly can be used to mark a page in a book while the bookmark assembly hangs out from the bottom portion of the book.

Yet still another object of the device is to provide a retractable connection cord that is connected to a closed end of the pen cap and that provides a means to removably attach a plurality of interchangeable bookmark assemblies.

Yet still another object of the device is to provide a recoil assembly located within the pen cap that provides a spring-loaded means of retracting the connection cord into the pen cap when use as a bookmark is not needed.

Yet still another object of the device is to provide a plurality of bookmark assemblies comprising a two-sided folded enclosure that is mechanically affixed to a distal end of the connection cord.

Yet still another object of the device is to provide a dual-purpose writing means and a retractable bookmarking means that can be conveniently carried in a pocket, pen or pencil holder, or the like which is especially convenient to a user during studying or other professional work.

Yet still another object of the device is to provide a method of utilizing the device which provides a unique and novel method to carry and provide all the items that may be needed when reading a book in a handy manner, which is quick, easy and effective.

Further objects and advantages of the device will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | pen/highlighter with retractable bookmark |
| 20 | pen-highlighter assembly |
| 21 | body |
| 22 | pen portion |
| 23 | highlighter portion |
| 24 | pen cap |
| 25 | clasp |
| 26 | highlighter cap |
| 29 | knot |
| 30 | cord |
| 31 | recoil mechanism |
| 33 | indicia |
| 34 | cord motion |
| 35 | orifice |
| 36 | spool |
| 38 | axle |
| 40 | spring |
| 41 | locking mechanism |
| 50 | bookmark assembly |
| 52 | first panel |
| 53 | second panel |
| 54 | hinge |
| 55 | latching feature |
| 56 | cord orifice |

DETAILED DESCRIPTION OF THE PREFERRED EMBODIMENT

Figure 1:
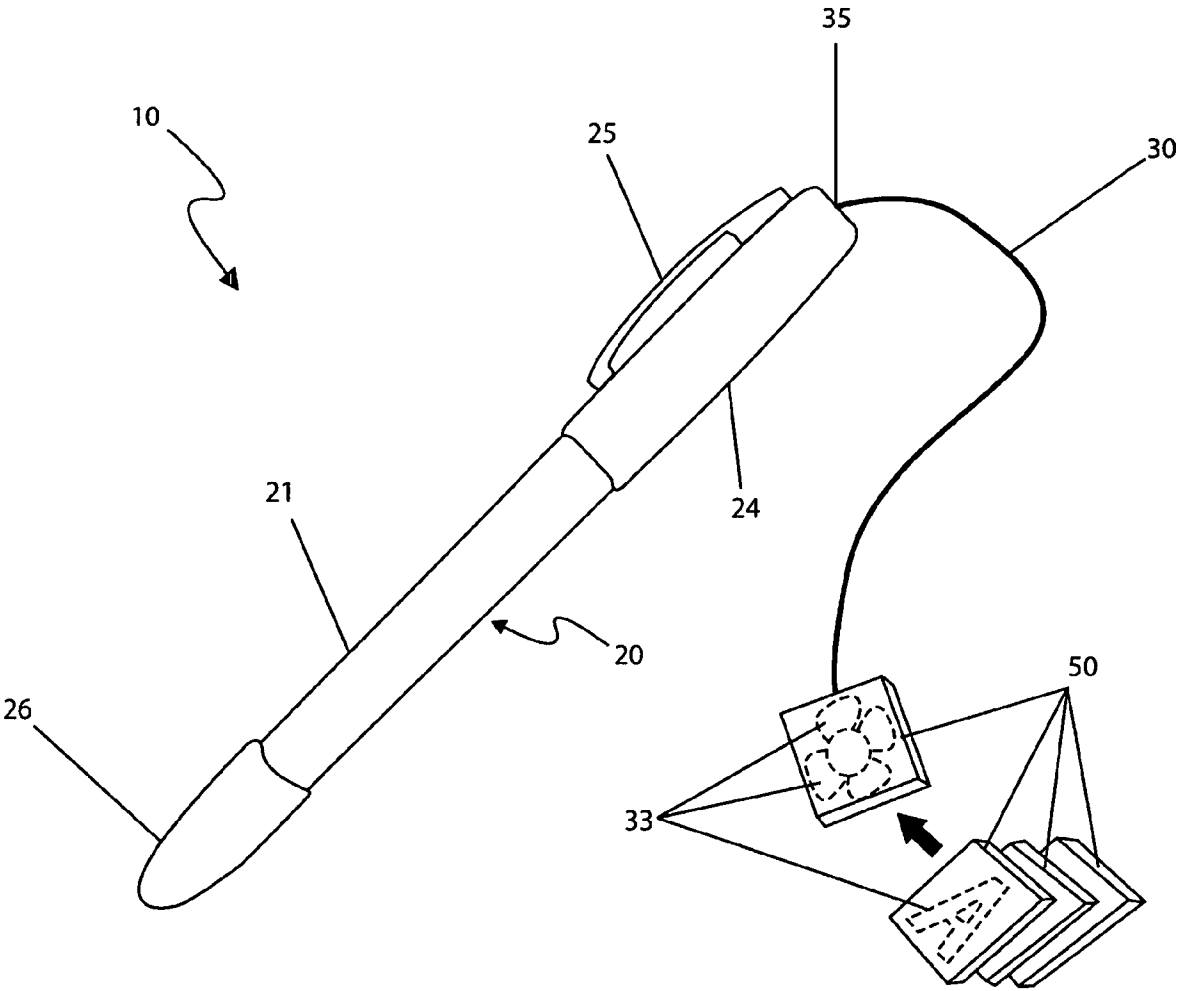
FIG. 1 is a perspective view of a pen/highlighter with retractable bookmark 10, according to a preferred embodiment of the present invention.
Figure 2A:
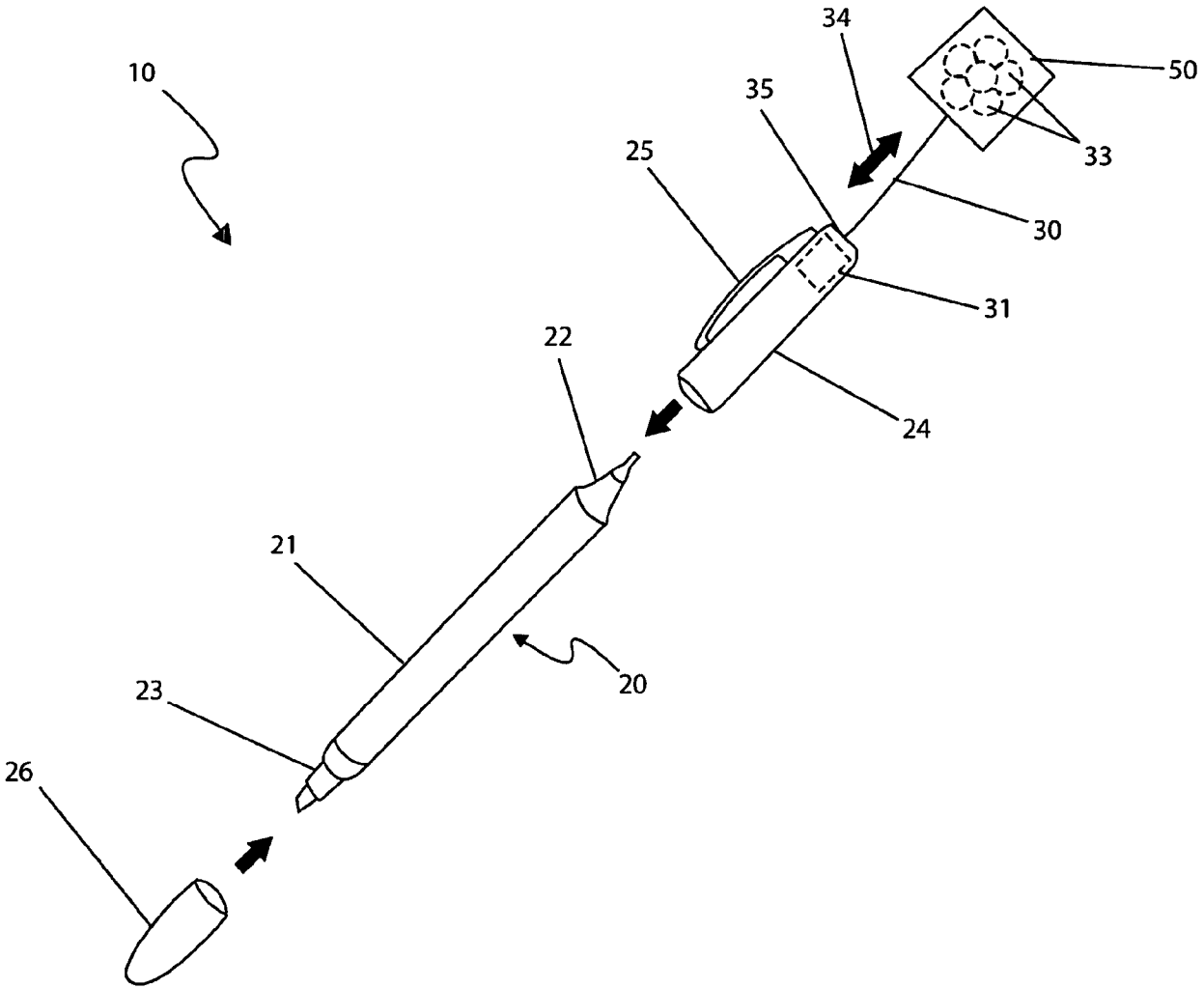
FIG. 2*a* is an exploded view of a pen/highlighter with retractable bookmark 10, according to a preferred embodiment of the present invention.
Figure 2B:
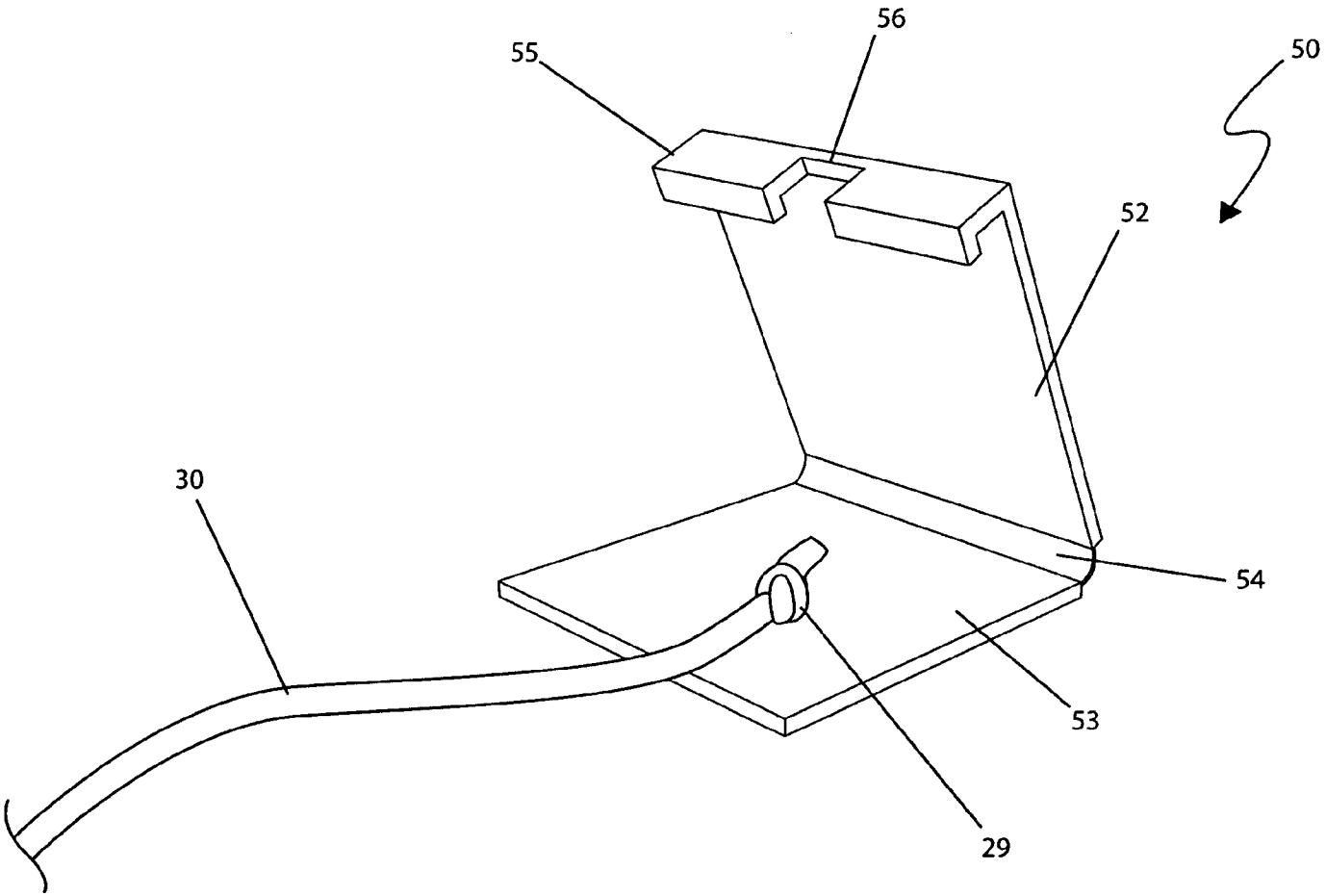
FIG. 2*b*, a close-up view of a bookmark assembly portion 50 of the device 10, according to the preferred embodiment of the present invention; and, FIG. 3 is a close-up cut-away view of a recoil mechanism portion 31 of the pen/highlighter with retractable bookmark 10, according to a preferred embodiment of the present invention.
Figure 3:
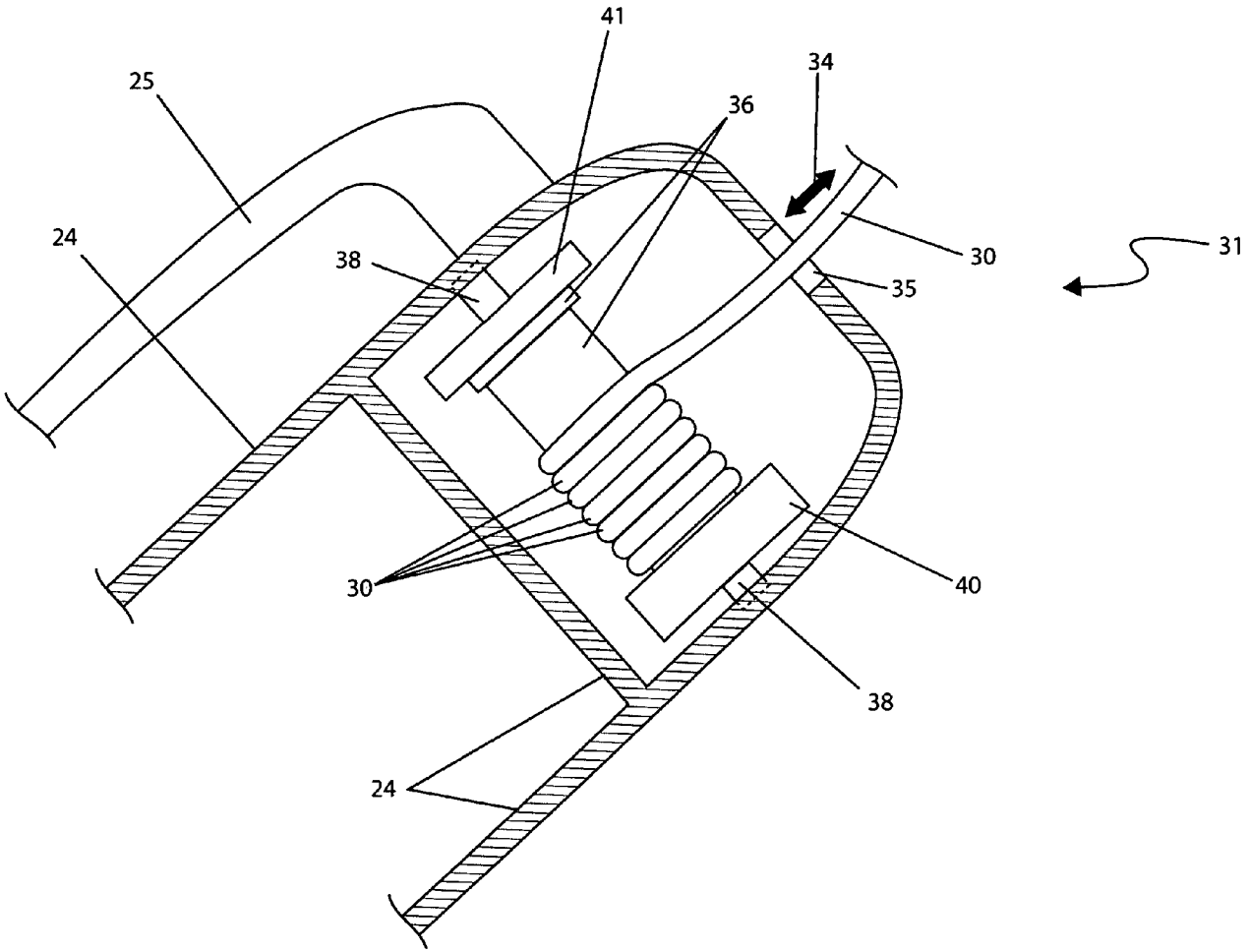

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a pen/highlighter with retractable bookmark 10 (herein described as the "device") 10, which combines functions of a writing pen 22, a highlighter 23, and a bookmark 50 into a combined device 10. The device 10 comprises a double-ended writing instrument having a first end comprising a ball point pen 22 and a second end comprising a color highlighter 23. Both the pen 22 and highlighter 23 are envisioned being disposable and replaceable, thereby allowing a user to refill the device 10 with refills comprising different color inks. A pen cap portion 24 comprises a pocket clasp 25 and a plurality of interchangeable bookmark assemblies 50 being tethered thereto the cap portion 24 and depicting indicia 33 such as a charm, a school or corporate logo, a sports team logo, an entertainment or musical icon, among others. A thin retractable cord 30 connects the bookmark assembly 50 to the cap portion 24 providing a recoiling mechanism 31 within said pen cap 24. In such a manner, the cord 30 and attached bookmark assembly 50 can be used to mark a page in a book while the bookmark assembly 50 hangs out of a bottom portion of said book.

Referring now to FIG. 1, a perspective view of the device 10, according to the preferred embodiment of the present invention, is disclosed. The device 10 comprises a pen/highlighter assembly 20, a pen cap 24, a highlighter cap 26, a cord 30, and a plurality of interchangeable bookmark assemblies 50. The device 10 is envisioned being made of durable plastic or metal materials and being introduced in a variety of colors, finishes, and printed patterns based upon a user's preference.

The pen/highlighter assembly 20 provides a dual-purpose writing and highlighting means thereto the device 10 being especially convenient to a user during studying. The pen/highlighter assembly 20 comprises a tubular body 21, a pen portion 22, and a highlighter portion 23. The body 21 provides a hollow cylindrical vessel having open end portions and straight or slightly convex side portions. Said tubular body 21 provides an attachment means thereto the pen 22 and highlighter 23 portions via an internal space (see FIG. 2*a*). The body 20 also provides an attachment means thereto the pen cap 24 and highlighter cap 26 being positioned at opposite ends of said body 20 being affixed thereto preferably using an interference friction or snap-in fit; however, other attachment methods may be provided such as a male/female snapping groove, threads, or the like. The pen cap 24 and highlighter cap 26 comprise generally cylindrical shapes with a single closed end providing an encapsulation means thereto included writing portions 22, 23, thereby retarding evaporation of included inks. The pen cap 24 further comprises an integrally-molded pocket clasp 25 protruding therefrom an outer surface forming a hook-shaped closure being anchored at a single end and being suitable for affixing the device 10 to a pocket, an article of clothing, or another convenient object. The pen cap 24 further provides an attachment means thereto a bookmark assembly 50 via a connecting cord 30 and an internal recoil mechanism 31 concealed therewithin said pen cap 24 (see FIG. 2). The cord 30 comprises a durable flexible element being made using a common connecting material such as, but not limited to: string, thin braided rope, fine chain, plastic coated braided cable, thin plastic tubing, or the like. The cord 30 further comprises a knot 29 being formed thereat an end portion, enabling removable attachment thereto a plurality of provided bookmark assemblies 50 (see FIG. 2*b*).

Referring now to FIG. 2*a*, an exploded view of the device 10, according to the preferred embodiment of the present invention, is disclosed. The device 10 comprises a pen portion 22, a highlighter portion 23, and a recoil mechanism 31. The body 21 provides an internal space to receive removably attachable pen 22 and highlighter 23 portions further comprising replaceable ink refills and colored highlighter ink reservoirs. The body 21 provides an attachment means thereto said pen 22 and highlighter 23 portions via circular female end openings sized so as to receive respective pen 22 and highlighter 23 portions being slidingly inserted therein forming a secure snapping or friction fit. The pen 22 and highlighter 23 portions are envisioned being similar to commercially available writing instruments being introduced with varying tip sizes, different color inks, and the like.

The pen cap 24 comprises an enclosure means thereto an internal recoil mechanism 31 which in turn provides extending and spring-loaded retracting means thereto the cord 30 and attached bookmark assembly 50, thereby resulting in a cord motion 34 (see FIG. 3).

Referring now to FIG. 2*b*, a close-up view of a bookmark assembly portion 50 of the device 10, according to the preferred embodiment of the present invention, is disclosed. The bookmark assembly 50 comprises a plastic two-sided folding enclosure being mechanically affixed thereto the cord 30 via a knot 29 tied therein an end portion of said cord 30. Each bookmark assembly 50 provides a personalized ornamental portion to the device 10 and is envisioned to provide a variety of shapes such as, but not limited to: round, rectangular, triangular, flower-shapes, alphabetic characters, numbers, or other symbols. The bookmark assembly 50 is also envisioned to include decorative and attractive indicia 33 along front and/or rear surfaces such as, but not limited to: various charms, school or corporate logos, sports team logos, entertainment or musical icons, among others (see FIG. 1). The bookmark assembly 50 comprises a first panel 52, a second panel 53, a hinge 54, a latching feature 55, and a cord orifice 56. The first 52 and second 53 panels comprise flat rectangular portions approximately one (1) inch square being joined thereby an integral hinging region 54 molded along a common edge. The hinge 54 comprises a molded-in thinner region allowing said first 52 and second 53 panels to pivot thereto a parallel position with respect with one another. The first panel 52 further comprises an "L"-shaped latching feature 55 opposite the hinge 54 and sized so as to secure a corresponding edge of the second panel 53. The latching feature 55 further comprises a rectangular cord orifice 56 at an intermediate location, thereby providing engagement and entrapment of the knot portion 29 of the cord 30 therewithin the bookmark assembly 50 when closed and latched using said latching feature 55.

Referring now to FIG. 3, a close-up cut-away view of a recoil mechanism portion 31 of the pen/highlighter with retractable bookmark 10, according to a preferred embodiment of the present invention, is disclosed. The pen cap 24 comprises an enclosure means thereto an internal recoil mechanism 31 which in turn provides a spring-loaded retracting and extending cord motion 34 thereto the cord 30 moving slidingly therethrough the orifice 35 portion of the pen cap 24 and located centrally along a closed end portion of said pen cap 24. The recoil mechanism 31 comprises a spool 36, an axle 38, a spring 40, and a locking mechanism 41. The recoil mechanism 31 provides extension and retraction of approximately twelve (12) inches of cord 30, functioning in a similar manner as units used to recoil vacuum cleaner power cords, extendable clothes lines, and the like. The spool 36 and axle 38 portions of the recoil mechanism 31 provide an anchored reeling means thereto the cord 30. The recoil mechanism 31 also provides a latching means thereto the cord 30 via the locking mechanism 41 being affixed thereto an end portion of the spool 36. In use, the cord 30 is extended slowly, followed by rapid retraction thereof causing a centrifugal force within the spool 36 to activate the locking mechanism 41, thereby securing a portion of said cord 30 outside the pen cap 24. The spring 40 comprises a common wire-type torsion spring, also mounted thereto the spool 36, which provides a torque thereto said spool 36 to retract the cord 30. The locking mechanism 41 allows a user to secure a maximum length as well as variable partial lengths of extended cord 30, thereby positioning the bookmark assembly 50 at a variable distance therefrom the pen cap 24.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be provided as indicated in FIG. 1.

The method of utilizing the device 10 may be achieved by performing the following steps: selecting and attaching a desired bookmark assembly 50 thereto the cord 30 by captivating the knot portion 29 of the cord 30 therewithin the bookmark assembly 50 using the latching feature 55 and cord orifice 56; snapping the first 52 and second 53 portions of the bookmark assembly 50 together; affixing the device 10 thereto one's pocket, purse, or other convenient location using the clasp 25, until needed; removing the pen cap portion 24 therefrom the device 10; writing or making notes using the pen portion 22 in a normal manner; removing the highlighter cap 26; highlighting particular passages in a book during study using the highlighter portion 23 in an expected manner; removing a spent or exhausted pen portion 22 or highlighter portion 23 therefrom the body 20; replacing said pen 22 or highlighter 23 portion with a provided or purchased replacement ink cartridge; utilizing the device 10 as a bookmarker by affixing the device 10 thereto a book binding using the clasp 25; pulling and extending the cord 30 and affixed bookmark assembly 50 slowly outwardly; retracting the cord 30 rapidly to activate the locking mechanism 41, thereby securing a portion of said cord 30 outside the pen cap 24; allowing the cord 30 to extend downward over a book page allowing the bookmark assembly 50 to dangle thereonto or below said page; closing said book thereupon the cord 30, thereby marking one's page; and, enjoying a convenient and compact dual writing instrument which provides an additional bookmark function.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A writing implement, further comprising:

a body, comprising a first side and a second side;

a first writing implement located at said first side;

a second writing implement located at said second side;

a first cap removably attached to said first side of said body for enclosing said first writing implement therein;

a second cap removably attached to said second side of said body for enclosing said second writing implement therein; and, a bookmarking means removably attached to said body therewith an attachment means;

wherein said body further comprising a hollow cylindrical vessel having an open end located at each of said first side and said second side for removably receiving said first writing implement and said second writing implement, respectively;

wherein said writing implement provides a writing implement means and said bookmarking means within a unitary device;

wherein said first cap further comprises a clasp protruding from an outer surface thereof;

wherein said writing implement further comprises interchangeable bookmarking means; and, wherein said attachment means further comprises:

a durable and flexible elongated construction;

a first cap attachment means located thereat a proximal end of said attachment means; and, a bookmarking attachment means at a distal end of said attachment means removably attachable to said bookmarking means;

wherein said first cap attachment means provides a recoiling means to said attachment means and an attached bookmarking means.

2. The implement of claim 1, wherein said first cap attachment means further comprises a recoil mechanism located in a tip portion of said first cap;

wherein said recoil mechanism provides a extension and retraction means to said attachment means.

3. The implement of claim 2, wherein said recoil mechanism further comprises:

a spool and an axle providing an anchored reeling means to said attachment means;

a spring mounted to said spool, thereby providing a torque means to said spool during said extension and retraction means; and, a locking mechanism affixed to an end portion thereof said spool, thereby providing a locking means to said attachment means;

wherein said locking mechanism enables a desired length of said attachment means, thereby positioning said bookmarking means at a desired distance from said first cap.

4. The implement of claim 2, wherein said bookmarking attachment means further comprises a knot formed at a distal end portion, thereby engaging said bookmarking means.

5. The implement of claim 1, wherein said bookmarking means further comprises:

an enclosure, comprising a first panel with an ornamental portion located on a top upper face of and a second panel;

a hinging portion for hingedly interconnecting a rear portion of each of said first panel and said second panel;

a latching portion for securing a front portion of each of said first panel and said second panel; and, an orifice located at a said latching portion;

wherein said hinging portion provides a hinging means for selectively opening and closing said enclosure between an open position and a closed position;

wherein said latching portion provides a latching and securing means to said enclosure in said closed position; and, wherein said orifice permits routing of said attachment means through said bookmarking means, when said enclosure is in said closed position.

6. The implement of claim 5, wherein said ornamental portion further comprises decorative indicia.

7. The implement of claim 1, wherein said first writing implement further comprises a pen.

8. The implement of claim 1, wherein said first writing implement further comprises a highlighter.

9. A writing implement, further comprising:

a body, having an open end located at each of said first side and said second side a first side and a second side;

a first writing implement located at said first side;

a first cap removably attached to said first side of said body for enclosing said first writing implement therein;

a second writing implement located at said second side;

a second cap removably attached to said second side of said body for enclosing said second writing implement therein;

a bookmark removably attached to said body with an attachment means, further comprising:

an enclosure, comprising a first panel with an ornamental portion located thereon a top upper face of and a second panel;

a hinging portion for hingedly interconnecting a rear portion of each of said first panel and said second panel, thereby providing a hinging means for selectively opening and closing said enclosure between an open position and a closed position;

a latching portion for securing a front portion of each of said first panel and said second panel, thereby providing a latching and securing means to said enclosure in said closed position; and, an orifice located at a said latching portion, thereby permitting routing of said attachment means through said bookmark, when said enclosure is in said closed position.

10. The implement of claim 9, wherein said attachment means further comprises:

a durable and flexible elongated construction;

a first cap attachment means located at a proximal end of said attachment means;

a recoil mechanism located in a tip portion thereof said first cap attached to said first cap attachment means; and, a bookmark attachment means at a distal end of said attachment means removably attachable to said bookmark;

wherein said first cap attachment means provides a recoiling means to said attachment means and an attached bookmark; and, wherein said recoil mechanism provides a extension and retraction means to said attachment means.

11. The implement of claim 10, wherein said recoil mechanism further comprises:

a spool and an axle providing an anchored reeling means to said attachment means;

a spring mounted to said spool, thereby providing a torque means to said spool during said extension and retraction means; and, a locking mechanism affixed to an end portion of said spool, thereby providing a locking means to said attachment means;

wherein said locking mechanism enables a desired length of said attachment means, thereby positioning said bookmark at a desired distance from said first cap.

12. The implement of claim 10, wherein said bookmark attachment means further comprises a knot formed at a distal end portion, thereby engaging said bookmark.

13. The implement of claim 9, wherein said ornamental portion further comprises decorative indicia.

14. The implement of claim 9, wherein said first writing implement further comprises a pen.

15. The implement of claim 9, wherein said first writing implement further comprises a highlighter.

16. A method of utilizing a combined writing implement with an interchangeable bookmark comprising the following steps:

providing said combined writing implement, further comprising:

a body, having an open end located at each of said first side and said second side a first side and a second side;

a pen located at said first side;

a first cap removably attached to said first side of said body for enclosing said pen therein, further comprising a clasp;

a highlighter located at said second side;

a second cap removably attached to said second side of said body for enclosing said highlighter therein;

a bookmark further comprising:

an enclosure, comprising a first panel with an ornamental portion located on a top upper face of and a second panel;

a hinging portion for hingedly interconnecting a rear portion of each of said first panel and said second panel, thereby providing a hinging means for selectively opening and closing said enclosure between an open position and a closed position;

a latching portion for securing a front portion of each of said first panel and said second panel, thereby providing a latching and securing means to said enclosure in said closed position; and, an orifice located at a said latching portion, thereby permitting routing of an attachment means through said bookmark, when said enclosure is in said closed position; and, said attachment means for attaching said bookmark to said body, further comprising:

a durable and flexible elongated construction;

a first cap attachment means located at a proximal end of said attachment means;

a recoil mechanism located in a tip portion of said first cap attached to said first cap attachment means, comprising a spool and an axle providing an anchored reeling means to said attachment means, a spring mounted to said spool providing a torque means to said spool during said extension and retraction means, and a locking mechanism affixed to an end portion of said spool, thereby providing a locking means to said attachment means at a desired length; and, a bookmark attachment means at a distal end of said attachment means removably attachable to said bookmark;

selecting and attaching a desired bookmark to said attachment means by routing said bookmark attachment means through said orifice of said latching portion;

captivating said bookmark attachment means within said desired bookmark with thereby utilizing said hinging means to manipulate said bookmark from said open position to said closed position and securing with said latching means;

affixing said combined writing implement to a desired location utilizing said clasp of said first cap removing said first cap, thereby exposing said pen to perform a desired writing task;

removing said second cap, thereby exposing said highlighter to perform another desired writing task;

replacing said pen in said first side of said body a with a replacement pen as desired;

replacing said highlighter in said second side of said body with a replacement highlighter as desired;

affixing said combined writing implement to a binding of a reading device using said clasp of said first cap;

utilizing said extension and retraction means to extend or retract said attachment means to a desired length with said recoil mechanism;

retracting said attachment means rapidly to activate said locking means and securing said attachment means at said desired length;

allowing said attachment means to extend downward over a desired location of said reading device, thereby allowing said bookmark to be suspended onto or below said desired location; and, closing said reading device upon said bookmark and said attachment device, thereby marking said desired location.

* * * * *